US006619092B2

(12) United States Patent
Nakayama et al.

(10) Patent No.: US 6,619,092 B2
(45) Date of Patent: Sep. 16, 2003

(54) TANDEM ROLLING MILL FACILITY AND ROLLING METHOD USING THE SAME

(75) Inventors: Toru Nakayama, Hitachi (JP); Michimasa Takagi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/943,359

(22) Filed: Aug. 31, 2001

(65) Prior Publication Data

US 2002/0108423 A1 Aug. 15, 2002

(30) Foreign Application Priority Data

Feb. 13, 2001 (JP) ..... 2001-036202

(51) Int. Cl.[7] ..... B21B 13/08
(52) U.S. Cl. ..... 72/234; 72/243.4; 72/366.2
(58) Field of Search ..... 72/226, 234, 242.2, 72/243.2, 243.4, 247, 249, 366.2

(56) References Cited

U.S. PATENT DOCUMENTS 4,712,416 A * 12/1987 Rommen et al. ..... 72/241.2
4,724,698 A * 2/1988 Ginzburg ..... 72/243.2
4,781,050 A * 11/1988 Winter et al. ..... 72/249
5,636,543 A * 6/1997 Kajiwara et al. ..... 72/234
5,927,127 A * 7/1999 Klamma et al. ..... 72/229
6,003,355 A * 12/1999 Yasuda et al. ..... 72/243.4

FOREIGN PATENT DOCUMENTS

JP 60-16283 4/1985

* cited by examiner

*Primary Examiner*—Ed Tolan
(74) *Attorney, Agent, or Firm*—Crowell & Moring LLP

(57) ABSTRACT

In a tandem rolling mill facility and a rolling method using the tandem rolling mill facility, stable rolling is performed with suppressing deflection of working rolls and without fluctuation of working roll bearing boxes. Axes of working rolls 1 are offset toward a side opposite to a side of larger tension between tensions acting on a rolled material at an inlet side and an outlet side with respect to axes of intermediate rolls, and a hydraulic cylinder for pushing a working roll bearing box toward the same side as the offset direction is contained in a block.

16 Claims, 4 Drawing Sheets

TANDEM ROLLING MILL FACILITY AND ROLLING METHOD USING THE SAME

BACKGROUND OF THE INVENTION

The present invention relates to a tandem rolling mill facility and a rolling method using the tandem rolling mill facility, and particularly, to a tandem rolling mill facility comprising a rolling mill line in which rolling mills are arranged in a plurality of stands aligned in a pass direction of a rolled material, each of the rolling mills having working rolls arranged so as to be offset with respect to rolls placed on and under the working rolls, and to a rolling method using the tandem rolling mill facility.

In general, a tandem rolling mill facility comprises a rolling mill line composed of a plurality of rolling mills, each of which has working rolls and supporting rolls placed on and under the working rolls, aligned in a pass direction of rolled material, and rolling work is performed using the working rolls as the driving roll while a tension is being added to a rolled material wound in a pay-off reel placed in an inlet side of the first stand and in a tension reel in an outlet side of the final stand. Further, there is a tandem rolling mill facility which has bridle rolls arranged in the inlet side or the outlet side of a rolling mill line composed of a plurality of rolling mills in order to add a desired tension to a rolled material, and the tandem rolling mill facility is installed in a continuous line. In the tandem rolling mill facilities described above, the working rolls are generally arranged with an offset so that the center axes of the working rolls are slightly displaced to the center axes of the supporting rolls placed on and under the working rolls in order to obtain a stable rolling condition, as described in Japanese Patent Publication No. 60-16283.

That is, in a case where there is a difference in tensions added to an inlet side and an outlet side of a rolled material, bearing boxes of the working rolls are always pushed toward a side of larger tension, the inlet side or the outlet side, by arranging the center axes of the working rolls so as to be offset toward the side of the larger tension with respect to the center axes of the supporting rolls placed on and under the working rolls, and consequently stable rolling can be attained. For example, in a conventional high-speed tandem rolling mill facility, in the first stand a tension in the outlet side is extremely large compared to a tension in the inlet side, and in the final stand a tension in the inlet side is extremely large compared to a tension in the outlet side. In such a facility, the center axes of the working rolls in the rolling mill placed at the first stand are arranged so as to be offset toward the outlet side of the rolled material with respect to the center axes of the supporting rolls arranged on and under the working rolls, and the center axes of the working rolls in the rolling mill placed at the final stand are arranged so as to be offset toward the inlet side of the rolled material to the center axes of the supporting rolls arranged on and under the working rolls. By doing so, a stable rolling condition can be obtained.

In recent years, users' requirements for properties of plate materials manufactured by rolling of various kinds of materials have become increasingly severe, and it is required to control the plate thickness in high accuracy. Further, there are very high needs to use small diameter working rolls because of requirements to increase a rolling-down ratio at rolling and to add higher gloss. However, there is a problem in that the working rolls are apt to be horizontally deflected to deteriorate the control characteristic of the plate shape if small diameter working rolls are used in the conventional tandem rolling mill facility.

That is, offset-arranging the working rolls as described above is producing a horizontal force (an offset force) in the working rolls, and a stable rolling condition can be obtained by adding the offset force in the same direction as the direction toward the side of the larger tensile. However, the working rolls are apt to be horizontally deflected to deteriorate the control characteristic of the plate shape because the horizontal force of the sum of the difference of tension and the offset force acts on the working rolls. When the horizontal force is constant, the tendency described above becomes larger as the diameter of the working rolls is smaller.

When the working rolls are arranged so as to be offset toward a side opposite to the side of larger tensile force of the rolled material with respect to the top and the bottom supporting rolls, the horizontal force acting on the working rolls becomes smaller because the difference of tensile force and the offset force are compensated with each other. However, when the working rolls are arranged so as to be offset as described above, there is a possibility that the direction of the horizontal load of the sum of the difference of tensile force and the offset force may be reversed between the inlet direction and the outlet direction by change in the rolling condition (that is, by the magnitude of the rolling load) because the magnitude of the offset force is determined by the rolling load.

Particularly in the final stand of the rolling mill line, the horizontal unbalance state due to the difference between the offset force and the tension is largely changed by rapid decrease of the tensile force in the outlet side caused by cutting of the rolled material using a shear machine placed behind (the outlet side of) the final stand. That is, the method of changing the offset arrangement in a direction so as to compensate the difference of tension with the offset force is not desirable for realizing stable rolling.

In the tandem rolling mill facility using small diameter working rolls which are apt to be deflected as described above, in order to reduce the horizontal force acting on the working rolls to suppress the horizontal deflection in taking the plate shape control characteristic into consideration, the center axes of the working rolls are arranged so as to be offset toward a side opposite to the side of larger tension with respect to the axes of the supporting rolls on and under the working rolls. However, in that case, it is difficult to realize stable tandem rolling because fluctuation of the working rolls may occur depending on change in the rolling condition, as described above. Further, there are some cases where an abnormal phenomenon such as occurrence of vibration sound during rolling or occurrence of periodical variation of plate thickness, called as chattering, in the rolled material.

SUMMARY OF THE INVENTION

A first object of the present invention is to provide a tandem rolling mill facility which can perform rolling excellent in the plate shape control characteristic using small diameter working rolls, and to provide a rolling method using the tandem rolling mill facility.

A second object of the present invention is to provide a tandem rolling mill facility which can compromise the conflicting characteristics when rolling is performed in a tandem rolling mill facility using the small diameter working rolls, and can realize rolling excellent in the plate shape control characteristic, and can attain a stable rolling condition.

(1) In order to attain the first object described above, a tandem rolling mill facility in accordance with the present invention comprises a rolling mill line aligning a plurality of rolling mills in a pass direction of a rolled material, the rolling mill having top and bottom working rolls and top and bottom supporting rolls arranged on and under the working rolls, wherein at least one rolling mill among the plurality of rolling mills is a working roll offset rolling mill in which the top and the bottom working rolls are used as driving rolls, and axes of the top and the bottom working rolls are arranged so as to be offset to a side opposite to a side of larger tension acting on the rolled material with respect to axes of the top and the bottom supporting rolls.

By arranging the axes of the top and the bottom working rolls so as to be offset to the side opposite to the side of larger tension acting on the rolled material with respect to the axes of the top and the bottom supporting rolls, a horizontal force acting on the working rolls can be reduced. As the result, the deflection of the working rolls can be decreased, and accordingly rolling excellent in plate shape control characteristic can be performed using small diameter working rolls.

(2) In the above item (1), it is preferable that the working roll offset rolling mill is arranged at least in the final stand of the rolling mill line.

Thereby, rolling excellent in plate shape control characteristic can be performed using small diameter working rolls in the final stand.

(3) Further, in order to attain the second object described above, in the tandem rolling mill facility described in the above item (1) or (2), the working roll offset rolling mill comprises an actuator for pushing bearing boxes of the top and the bottom working rolls against fixed portions.

By providing the actuator for pushing the top and the bottom working rolls as described above, even if a direction of a horizontal force of the sum of a difference of tensions and an offset force is reversed between the inlet side and the outlet side due to change in the rolling condition particularly in the final stand, it is possible to prevent the working roll bearing box from moving. Therefore, rolling excellent in plate shape control characteristic can be performed using small diameter working rolls, as described above, and a stable rolling condition can be obtained.

(4) In the above item (3), it is preferable that the actuator is arranged so as to push the bearing boxes of the top and the bottom working rolls to the same side as the offset direction of the top and the bottom working rolls.

Thereby, during normal rolling, the working roll bearing boxes can be stably held with a weak force because the horizontal force acting on the working rolls is a force toward the outlet side (the offset direction of the working rolls) in most cases particularly in the rolling mill in the final stand.

(5) In the above items (1) to (4), it is preferable that the top and the bottom working rolls are comparatively small diameter working rolls having B/L smaller than 0.26, where B is a diameter of the top and the bottom working rolls and L is a plate width of the rolled material.

By applying the present invention to the comparatively small diameter working rolls having B/L smaller than 0.26, the maximum horizontal deflection of the working roll can be substantially reduced, and accordingly rolling excellent in plate shape control characteristic can be performed using small diameter working rolls.

(6) Further, in order to attain the second object described above, in the tandem rolling mill facility described in the above item (1), all of the plurality of rolling mills are the working roll offset rolling mills, and at least the rolling mill placed in the final stand of the rolling mill line comprises an actuator for pushing bearing boxes of the top and the bottom working rolls against fixed portions.

Thereby, the horizontal force acting on the working rolls in all the rolling mills can be decreased, and the horizontal deflection of the working rolls can be decreased, and accordingly rolling excellent in plate shape control characteristic can be performed using small diameter working rolls. Further, even if a direction of a horizontal force is reversed in the final stand, it is possible to prevent the working roll bearing box from moving. Therefore, a stable rolling condition can be obtained.

(7) Further, in order to attain the first object described above, a tandem rolling mill facility in accordance with the present invention comprises a rolling mill line aligning a plurality of rolling mills in a pass direction of a rolled material, the rolling mill having top and bottom working rolls and top and bottom supporting rolls arranged on and under the working rolls, wherein at least one rolling mill placed in the final stand among the plurality of rolling mills is a rolling mill in which the top and the bottom working rolls are used as driving rolls, and axes of the top and the bottom working rolls are arranged so as to be offset to an outlet side of the rolled material with respect to axes of the top and the bottom of supporting rolls, and the other rolling mills are rolling mills in which the top and the bottom working rolls are used as driving rolls, and axes of the top and the bottom working rolls are arranged so as to be offset to an inlet side of the rolled material with respect to axes of the top and the bottom supporting rolls.

(8) Further, in order to attain the second object described above, in the tandem rolling mill facility of the item (7), at least the one rolling mill placed in the final stand comprises an actuator for pushing bearing boxes of the top and the bottom working rolls against fixed portions.

Thereby, even if a direction of a horizontal force is reversed in the final stand, it is possible to prevent the working roll bearing box from moving. Therefore, a stable rolling condition can be obtained.

(9) Further, in order to attain the first object described above, a tandem rolling mill facility in accordance with the present invention comprises a plurality of rolling mills each having a pair of top and bottom working rolls, and a pair of supporting rolls, wherein an offset means for offsetting the working rolls toward an outlet side of a rolled material with respect to the supporting rolls is provided at least the rolling mill in a final stand.

Thereby, the deflection of the working rolls can be decreased, as described above, and accordingly rolling excellent in plate shape control characteristic can be performed using small diameter working rolls.

(10) Further, in order to attain the first object described above, a tandem rolling mill facility in accordance with the present invention comprises a plurality of rolling mills each having a pair of top and bottom working rolls, and a pair of supporting rolls, wherein an offset means for offsetting the working rolls toward an outlet side of a rolled material with respect to the supporting rolls is provided at least the rolling mill in a final stand, and an offset direction by said offset means is a direction opposite to a side of larger tension acting on the rolled material.

Thereby, the deflection of the working rolls can be decreased, as described above, and accordingly rolling excellent in plate shape control characteristic can be performed using small diameter working rolls.

(11) Further, in order to attain the first object described above, a rolling method in accordance with the present invention uses a tandem rolling mill facility which comprises a plurality of rolling mills each having a pair of top and bottom working rolls, and a pair of supporting rolls, wherein an offset means for offsetting the working rolls toward an outlet side of a rolled material with respect to the supporting rolls is provided at least the rolling mill in a final stand, and rolling is performed while the working rolls are being offsetting to a direction opposite to a side of larger tension acting on the rolled material by the offset means.

Thereby, the deflection of the working rolls can be decreased, as described above, and accordingly rolling excellent in plate shape control characteristic can be performed using small diameter working rolls.

EXPLANATION OF REFERENCE NUMBERS

Figure 1:
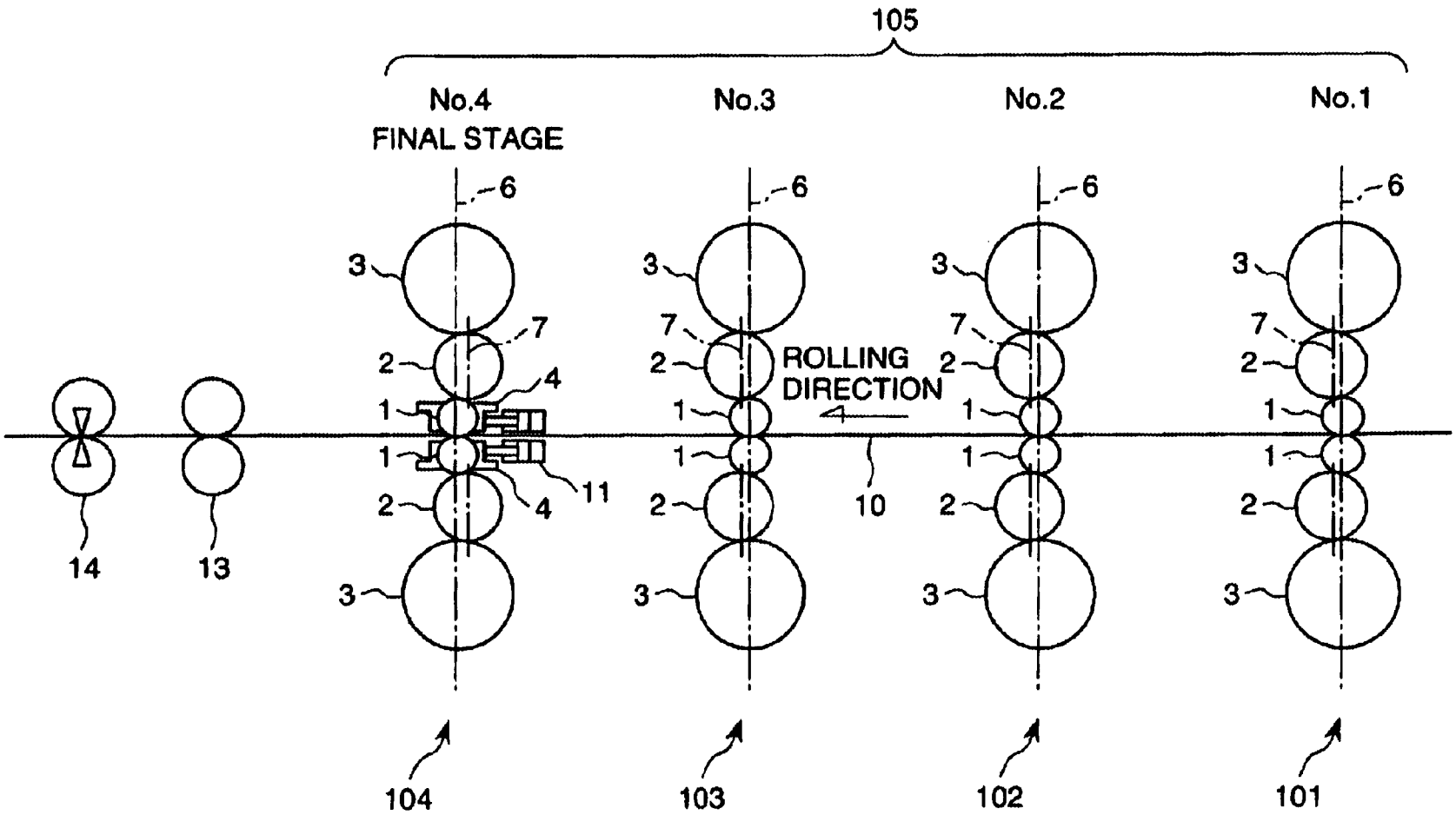
FIG. 1 is a diagram showing the layout of a tandem rolling mill facility in accordance with the present embodiment.

1 working roll
2 counter-material roll
3 reinforcing roll
4 working roll bearing box
5 reinforcing roll bearing box
6 axis of working roll
7 axis of counter-material roll
8 inlet side block
9 outlet side block
10 rolled material
11 cylinder
12 housing
13 pinch roller
14 shear machine
101–104 rolling mill
105 rolling mill line

DESCRIPTION OF PREFERRED EMBODIMENTS OF THE INVENTION

An embodiment of a tandem rolling mill in accordance with the present invention will be described below. In the embodiment to be described below, the present invention is applied to a cold work tandem rolling mill facility. The present invention is not limited to the cold work tandem rolling mill facility, but the present invention is particularly suitable for applying to the cold work tandem rolling mill facility because cold work rolling requires a particularly high accuracy in plate shape control.

FIG. 1 is a diagram showing the layout of a tandem rolling mill facility in accordance with the present embodiment. The tandem rolling mill facility comprises four rolling mills 101, 102, 103 and 104, and these rolling mills 101, 102, 103 and 104 are sequentially arranged on a first, and a second and a third stands in the middle, and the final stand to form a rolling mill line 105. A rolled material 10 unwound from a pay-off reel, not shown, and sent to the rolling mill line 105 successively passes through the first stand, the second and the third stands and the final stand to be rolled by the rolling mills 101, 102, 103 and 104. The rolled material 10 after being rolled passes through an outlet side pinch roller 13 and a shear cut machine 14, and then is wound in a tension reel, not shown. When a preset amount of the rolled material is wound in the tension reel, the rolled material 10 is cut by the shear cut machine 14. At that time, the tension in the outlet side of the final stand is given by the pinch roller 13.

Figure 2:
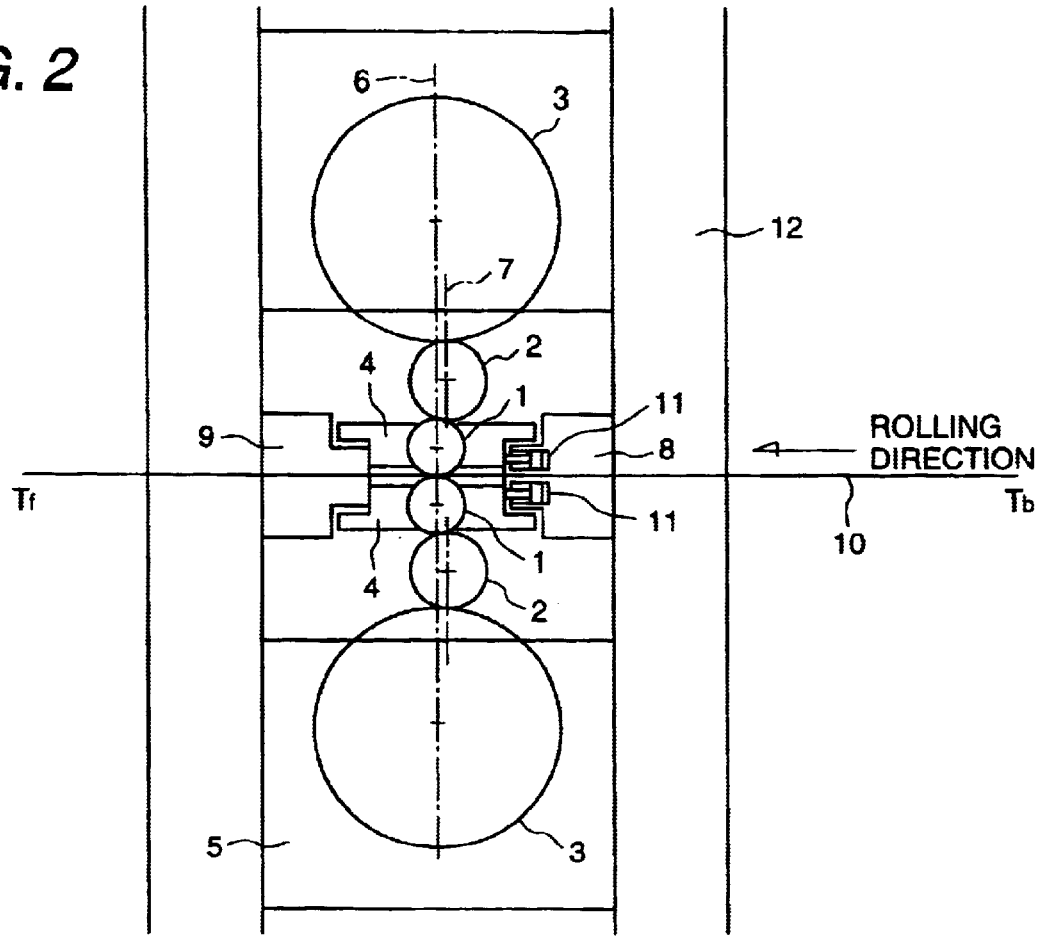
FIG. 2 is a schematic side view showing the construction of a rolling mill in the final stand.

FIG. 2 is a schematic side view showing the construction of the rolling mill 104 in the final stand. This rolling mill 104 is a 6-stage rolling mill comprising a pair of top and bottom working rolls 1, 1; a pair of top and bottom intermediate rolls 2, 2 arranged on and under the working rolls 1; and a pair of top and bottom reinforcing rolls 3,3 bearing the rolling load with bearing boxes 5. The working rolls 1, 1 are supported by bearing boxes 4, 4, and the bearing boxes 4, 4 are held by inlet side and an outlet side blocks 8, 9. The top and the bottom working rolls 1, 1 are coupled with driving spindles, not shown, and directly driven by a driving unit, not shown. That is, the rolling mill 104 is a rolling mill using the top and the bottom rolls 1, 1 as driving rolls.

Further, in FIG. 2, the reference character 6 is a perpendicular passing through axes of the top and the bottom working rolls 1, 1, and the reference character 7 is a perpendicular passing through axes of the top and the bottom intermediate rolls 2, 2, and the top and the bottom working rolls 1, 1 are arranged so that the axes of the working rolls are offset toward the outlet side of the rolled material with respect to the axes of the top and the bottom intermediate rolls 2, 2 arranged on and under the working rolls. In the final stand placing the rolling mill 104, the tension Tb in the inlet side is larger than the tension Tf in the outlet side. Therefore, the axes of the working rolls 1, 1 are arranged so as to be offset toward a side opposite to a side of larger tension with respect to the axes of the intermediate rolls 2, 2.

In the inlet side blocks 8, looseness-removing hydraulic cylinders 11, 11 for pushing the bearing boxes 4, 4 of the working rolls 1, 1 to the outlet side blocks 9 in the opposite side, that is, in the same side as the offset direction of the working rolls 1, 1, are contained.

In regard to the rolling mills 101 to 103, the axes of the working rolls 1, 1 are arranged so as to be offset toward the inlet side of the rolled material 10 with respect to the axes of the intermediate rolls 2, 2 arranged on and under the working rolls. In the first to the third stands, particularly in the first stand, the tension in the outlet side is large compared to the tension in the inlet side. Therefore, in the rolling mills 101 to 103 in the first to the third stands, the axes of the working rolls 1, 1 are arranged so as to be offset toward a side opposite to a side of larger tension with respect to the axes of the intermediate rolls 2, 2. Further, since fluctuation of the tension in the rolling mills 101 to 103 in the first to the third stands is small, no looseness-removing hydraulic cylinders are arranged in the rolling mills 101 to 103. Therein, in order to secure the stability of rolling condition, the looseness-removing hydraulic cylinders may be provided to the rolling mills 101 to 103 in the first to the third stands. The other structures of the rolling mills 101 to 103 are the same as those of the rolling mill 104 in the final stand.

Figure 3:
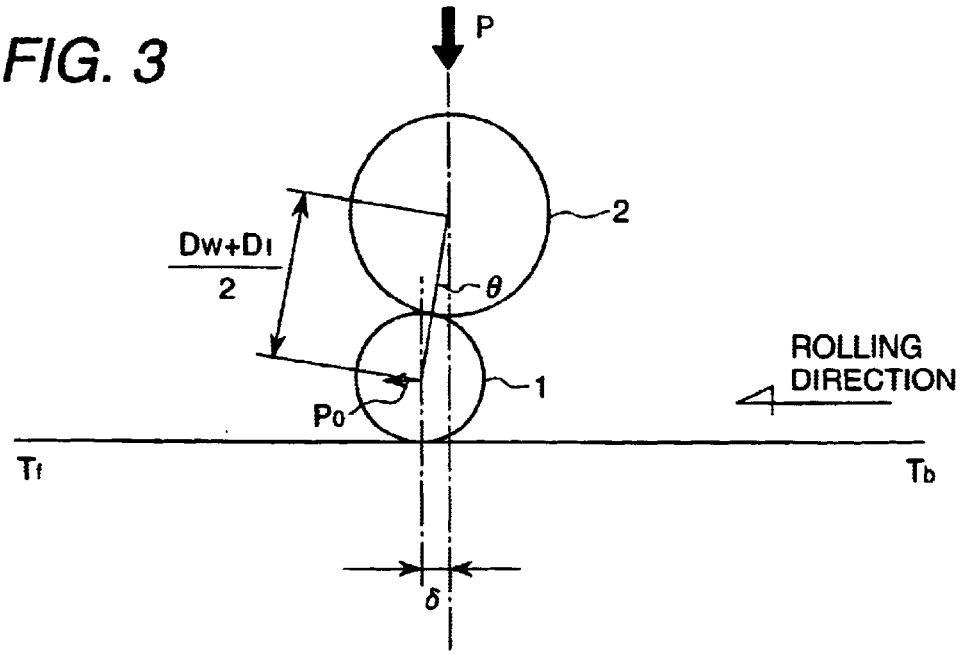
FIG. 3 is a view explaining how a horizontal force acts on a working roll depending on an offset arrangement of the working roll in the rolling mill in the final stand.

FIG. 3 is a view explaining how a horizontal force acts on a working roll depending on an offset arrangement of the working roll in the rolling mill 104 in the final stand. In the rolling mill 104 in the final stand, a horizontal force by a rolling load P, that is, an offset force $P_0$ acts on the working roll 104 in the final stand, and an outlet side tension Tf in the pass direction side and an inlet side tension Tb in the opposite direction cut on the rolled material 10.

Here, letting the diameter of the working roll 1 be DW, the diameter of the intermediate roll 2 be DI, an offset amount of the difference between the axis of the working roll and the axis of the intermediate roll be δ, an angle between the perpendicular passing through the axis of the intermediate roll and a straight line passing through the axis of the working roll and the axis of the intermediate roll be θ, $$\tan\theta = 2\delta/(DW+DI) \quad (1)$$

and the offset force P can be expressed by the following equation.

$$P_0 = P \times \tan\theta \quad (2)$$

Therefore, the horizontal force $P_1$ becomes as follows.

$$P_1 = P_0 + \{(Tf-Tb)/2\} + \mu P \cdot D_{BRG}/DI \quad (3)$$

$D_{BRG}$: diameter of the bearing of the intermediate roll
$\mu$: friction coefficient of the bearing Therefore, when the working roll is offset toward the outlet side as shown in the figure and the outlet side direction (pass direction) of the coordinate is taken as the positive direction, in the final stand where the rolling condition has a strong tendency of the tension Tb in the inlet side>the tension Tf in the outlet side, the first term in Equation (1) becomes a positive value, the second term becomes a negative value. As the result, the first term and the second term compensate with each other to reduce the horizontal force $P_1$ and to decrease the horizontal deflection of the working roll. Therefore, rolling excellent in shape control characteristic can be performed.

Further, the hydraulic cylinder 11 attached in the block 8 pushes the bearing box 4 of the working roll toward the outlet side of the rolled material with a force F. By pushing the bearing box 4 of the working roll with the force F, the bearing box 4 of the working roll can be stabilized against the fluctuation of the horizontal force $P_1$, and accordingly can contribute to stable rolling.

In the first to third stands where the rolling condition has a strong tendency of the tension Tb in the inlet side<the tension Tf in the outlet side, the first term in Equation (1) becomes a negative value, the second term becomes a positive value. Similarly, the first term and the second term compensate with each other to reduce the horizontal force $P_1$ and to decrease the horizontal deflection of the working roll. Therefore, rolling excellent in shape control characteristic can be performed.

As an example, in the final stand, the axis of the working roll 1 is offset in the outlet direction of the rolled material 10 by 5 mm with respect to the axis of the intermediate roll 2, and the bearing box 4 of the working roll 1 is pushed toward the outlet direction with a force of approximately 10 tons by the hydraulic cylinder 11 so as to be stabilized. In the stands other than the final stand, the axis of the working roll 1 is offset in the inlet direction of the rolled material 10 by 5 mm with respect to the axis of the intermediate roll 2.

Figure 4:
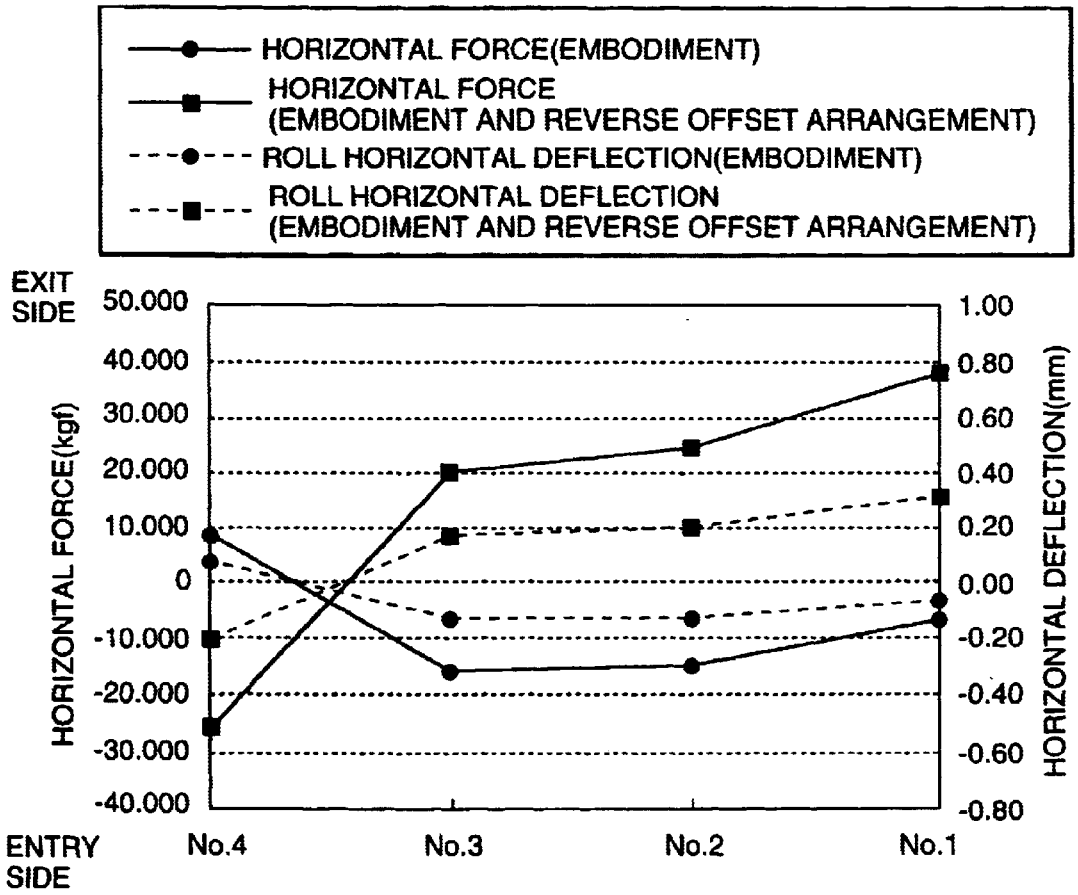
FIG. 4 is an explanatory diagram showing horizontal forces acting on working rolls and horizontal deflections (differences between a position in the middle of rolled material width and a position in the end) caused by the horizontal forces in a typical rolling schedule of an embodiment of a tandem rolling mill facility in accordance with the present invention, and also shows that the deflection caused by the horizontal force added to the working roll is effectively suppressed.

FIG. 4 is a diagram showing a horizontal force calculated from a rolling load P, a tension difference in a stand and an offset force, and a horizontal deflections (differences between a position in the middle of rolled material width and a position in the end) of the working roll for each of the stands based on a typical rolling schedule in the tandem rolling mill facility of FIG. 1. The tension difference in a stand is a difference between tensions in the front and the back of the stand, and the outlet side direction of the coordinate is positive. The offset force and the horizontal force are calculated based on Equations (2) and (3). Further, FIG. 4 also shows a horizontal force and a horizontal deflection of the working roll caused by the horizontal force for each stand in a case where on the contrary to the above embodiment, in the final stand the axis of the working roll is offset toward the inlet side (a side of larger tension or in the same direction as the direction of tension difference) by 5 mm with respect to the intermediate roll, and in the other stands the axis of the working roll is offset toward the outlet side (a side of larger tension or in the same direction as the direction of tension difference) by 5 mm with respect to the intermediate roll. Therein, the diameter B of the working roll is 320 mm, and the plate width L of the rolled material is 1300 mm, and accordingly B/L=0.25.

It can be understood from FIG. 4 that if the axis of the working roll in the first stand is offset toward the same direction as the direction of the tension difference (the outlet side) by 5 mm in the tandem rolling mill facility of B/L=0.25, the horizontal force $P_1$ becomes approximately 38,000 kgf (to the outlet side), and the horizontal deflection of the working roll becomes up to approximately 0.32 mm (to the outlet side). However, in the present embodiment, because the axis of the working roll is offset toward the direction opposite to the direction of the tension difference (toward the inlet side) by 5 mm, the horizontal force $P_1$ becomes approximately 6,500 kgf (to the inlet side), and the horizontal deflection of the working roll is suppressed to approximately 0.054 mm (to the inlet side). Because there is a strong tendency of excess of tension in the inlet side in the final stand, the axis of the working roll is offset toward the outlet side of the rolled material which is opposite to the direction in the first stand. If the axis of the working roll is offset toward the same direction as the direction of the tension difference (the inlet side) by 5 mm, the horizontal force $P_1$ becomes approximately 26,000 kgf (to the outlet side), and the horizontal deflection of the working roll becomes up to approximately 0.22 mm (to the inlet side). On the other hand, in the present embodiment, because the axis of the working roll is offset toward the direction opposite to the direction of the tension difference (toward the outlet side) by 5 mm, the horizontal force $P_1$ becomes approximately 8,400 kgf (to the outlet side), and the horizontal deflection of the working roll is suppressed to approximately 0.070 mm (to the outlet side).

Figure 5:
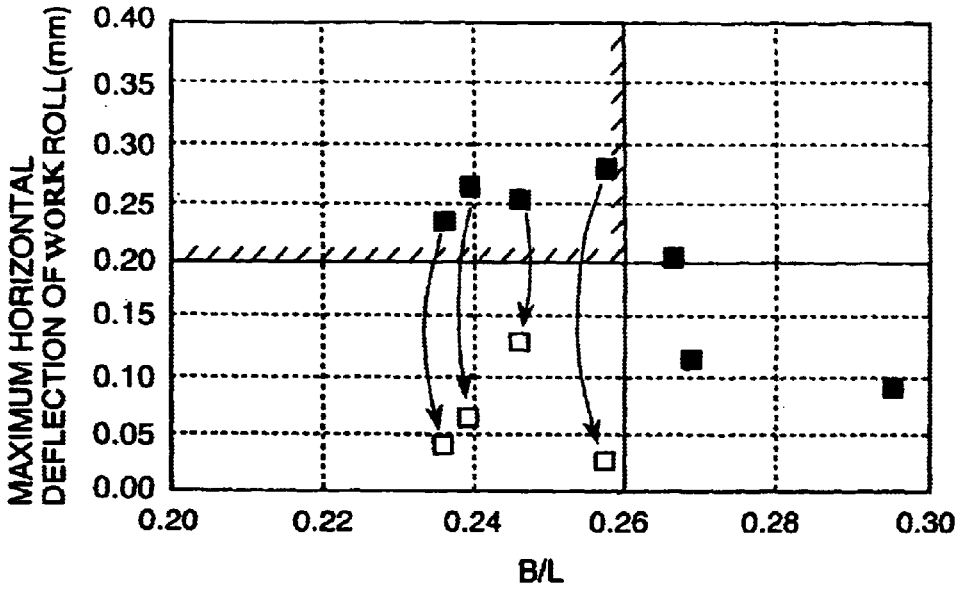
FIG. 5 is an explanatory diagram showing that there is a certain relationship between a deflection of the working roll and a diameter B of the working roll and a plate width L of the rolled material in the final stand of an embodiment of a tandem rolling mill facility in accordance with the present invention, and also showing that the rolling mill having comparatively small diameter working rolls within the range of $B/L>0.26$ can suppress the horizontal deflection to a value comparable to a deflection in a rolling mill having a conventional common diameter working rolls by employing the offset arrangement in accordance with the present invention.

FIG. 5 shows the calculation results (the marks ■ in the graph) of relationship between the ratio B/L of the diameter B of working roll used to the plate width L of rolled material used and the maximum deflections (differences between a position in the middle of rolled material width and a position in the end) of working roll in the final stand caused by offsetting the axis of the working roll in the same direction as the direction of the tension difference by 5 mm. It can be understood from the graph that in the cases where the working roll in the final stand is offset to the same side as the direction of the tension force, the maximum deflection exceeds the allowable value of 0.2 mm in the tandem rolling mill facility using the working rolls having a comparatively small diameter within the range of B/L<0.26. However, by offsetting the axis of the working roll toward the side opposite to the direction of the tension difference as described above, the horizontal force is reduced, and as the result the deflection of the working roll can be suppressed below 0.2 mm (the marks □ in the graph) to effectively improve the quality of the rolled material.

The effect of the hydraulic cylinders 11 provided in the rolling mill 104 in the final stand will be described below.

Referring to FIG. 1, when the rolled material 10 is cut in the shear cut machine 14 placed in the outlet side of the outlet side pinch roller 13, the tension in the outlet side of the final stand is added by the pinch roller 13. However, the tension in the outlet side is decreased to about 1 ton due to the limit of the machine ability of the pinch roller 13, and accordingly the difference of the tension in the front and the back of the final stand is changed. That is, the excess of tension difference in the inlet side in the final stand is increased. In the case where the offset force $P_0$ of the working roll is the same direction as the tension difference (the inlet side), the working roll bearing boxes are not fluctuated by the change in the tension difference. However, in the case where the tension difference and the offset force $P_0$ are compensated with each other by offsetting the working roll in the direction opposite to the tension difference (toward the outlet side), as the present embodiment, the change in the tension difference due to shear cut substantially influences the horizontal force $P_1$ because the offset force $P_0$ is small particularly when the rolling-down ratio, that is, the rolling load is relatively small.

Figure 6:
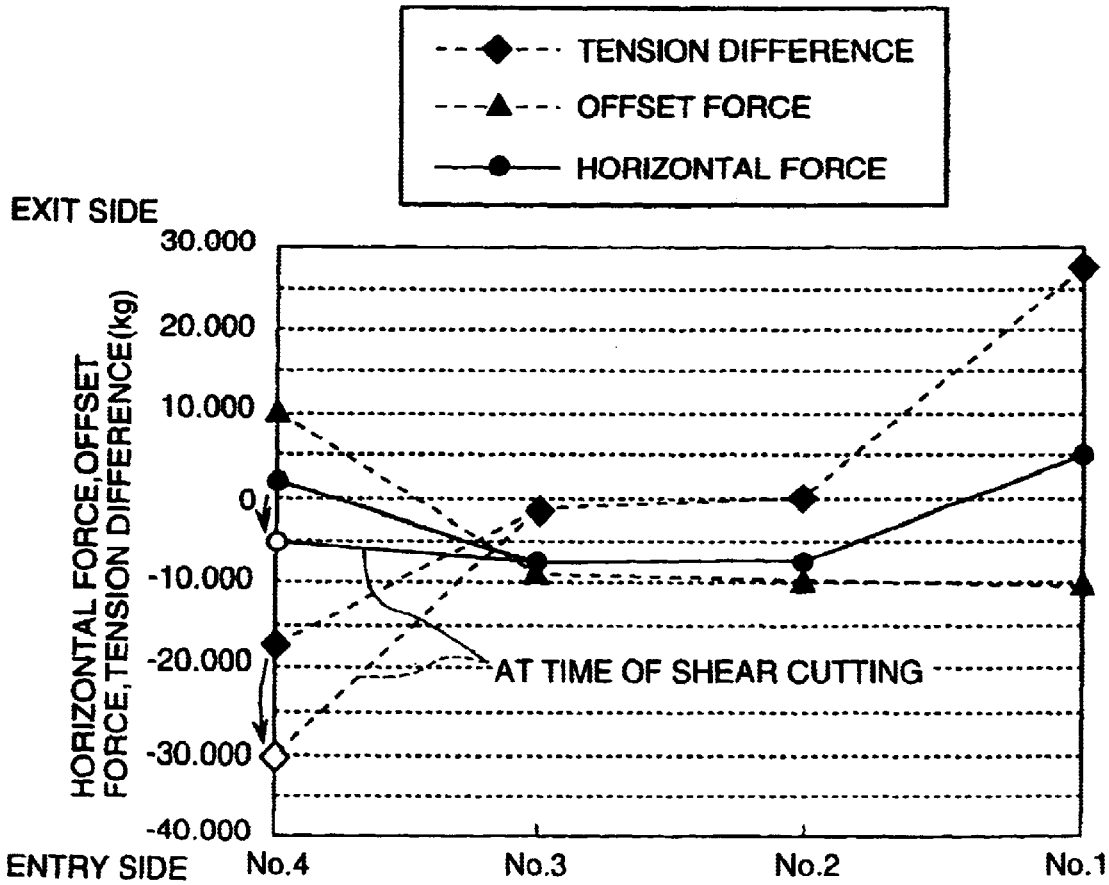
FIG. 6 is a diagram showing a typical rolling schedule having a relatively low rolling load in an embodiment of a tandem rolling mill facility in accordance with the present invention, and also showing that in the final stand, the direction of the difference of tensions is reversed from positive to negative due to change in the tension caused by cutting of the rolled material by a shear machine in the outlet side.

FIG. 6 is a diagram showing a typical rolling schedule having a relatively low rolling load in an embodiment of a tandem rolling mill facility in accordance with the present invention, and also showing that in the final stand, the direction of the difference of tensions is reversed from positive to negative due to change in the tension caused by cutting of the rolled material by a shear machine in the outlet side. Therein, the diameter B of the working roll is 320 mm, and the plate width L of the rolled material is 920 mm.

It can be understood from FIG. 6 that when the rolled material 10 is cut from the rolling state by the outlet side shear machine 14, the difference of tensions in the front and the back of the final stand is changed from approximately 18,000 kg in the inlet side direction to approximately 31,700 kg, and the force acting on the bearing box 4 of the working roll, that is, the horizontal force $P_1$ is changed from 1,290 kg to −5,500 kg taking the outlet side as the positive direction, and accordingly is reversed from a positive value to a negative value. At that time, there occurs a difficulty in stable rolling caused by motion in a small gap between the bearing box 4 of the working roll and the block 8. However, since the bearing box 4 of the working roll is pushed toward the outlet side with approximately 10 tons stronger than that force by the hydraulic cylinder 11, as in the present embodiment, the bearing box 4 of the working roll is always pushed against the outlet side and accordingly unstable rolling caused by fluctuation of the working roll due to the fluctuation of the bearing box 4 of the working roll does not occur.

On the other hand, during normal rolling, since in most cases the horizontal force acting on the working roll is a force toward the outlet side (in the offset direction of the working roll), the bearing box of the working roll can be stably held with a small force by arranging the hydraulic cylinder 11 so as to push the bearing box 4 of the working roll 1 against the outlet side block 9 in the same side as the offset direction of the working roll 1.

Although the rolling mill in each of the stands composing the tandem rolling mill facility in the above-mentioned embodiment is a 6-stage rolling mill, all the rolling mills or part of the rolling mills may be 4-stage rolling mills.

According to the present invention, in the tandem rolling mill facility and the rolling method using the tandem rolling mill facility, deflection of the working rolls can be minimized, and accordingly rolling excellent in shape control performance can be performed.

Further, according to the present invention, fluctuation of the working roll bearing box can be suppressed, and accordingly stable rolling excellent in shape control performance can be performed.

What is claimed is:

1. A tandem rolling mill facility comprising a rolling mill line aligning a plurality of rolling mills in a pass direction of a rolled material, said rolling mill having top and bottom working rolls and top and bottom supporting rolls arranged on and under said working rolls, wherein at least one rolling mill placed in the final stand among said plurality of rolling mills is a working roll offset rolling mill in which said top and said bottom working rolls are used as driving rolls, and axes of said top and said bottom working rolls are arranged so as to be offset to a rolled material outlet side opposite to a side of larger tension acting on the rolled material with respect to axes of said top and said bottom supporting rolls.

2. A tandem rolling mill facility according to claim 1, wherein said working roll offset rolling mill comprises an actuator for pushing bearing boxes of said top and said bottom working rolls against fixed portions.

3. A tandem rolling mill facility according to claim 2, wherein said top and said bottom working rolls are comparatively small diameter working rolls having B/L smaller than 0.26, where B is a diameter of said top and said bottom working rolls and L is a plate width of the rolled material.

4. A tandem rolling mill facility according to claim 2, wherein said actuator is arranged so as to push the bearing boxes of said top and said bottom working rolls to the same side as the offset direction of said top and said bottom.

5. A tandem rolling mill facility according to claim 4, wherein said top and said bottom working rolls are comparatively small diameter working rolls having B/L smaller than 0.26, where B is a diameter of said top and said bottom working rolls and L is a plate width of the rolled material.

6. A tandem rolling mill facility according to claim 1, wherein said top and said bottom working rolls are comparatively small diameter working rolls having B/L smaller than 0.26, where B is a diameter of said top and said bottom working rolls and L is a plate width of the rolled material.

7. A tandem rolling mill facility according to claim 1, wherein all of said plurality of rolling mills are said working roll offset rolling mills, and the rolling mill placed in the first stand of said rolling mill line comprises an actuator for pushing bearing boxes of said top and said bottom working rolls against fixed portions.

8. A tandem rolling mill facility comprising a rolling mill line aligning a plurality of rolling mills in a pass direction of a rolled material, said rolling mill having top and bottom working rolls and top and bottom supporting rolls arranged on and under said working rolls, wherein at least one rolling mill placed in a final stand among said plurality of rolling mills is a rolling mill in which said top and said bottom working rolls are used as driving rolls, and axes of said top and said bottom working rolls are arranged so as to be offset to an outlet side of the rolled material with respect to axes of said top and bottom supporting rolls, and the other rolling mills are rolling mills in which said top and bottom working rolls are used as driving rolls, and axes of said top and bottom working rolls of the other rolling mills are arranged so as to be offset to an inlet side of the rolled material with respect to axes of said top and said bottom supporting rolls.

9. A tandem rolling mill facility according to claim 8, wherein at least said one rolling mill placed in the final stand comprises an actuator for pushing bearing boxes of said top and said bottom working rolls against fixed portions.

10. A tandem rolling mill facility comprising a rolling mill line aligning a plurality of rolling mills in a pass direction of a rolled material, said rolling mills having respective top and bottom working rolls and top and bottom supporting rolls arranged on and under said working rolls, wherein one rolling mill placed in the final stand among said plurality of rolling mills is a working roll offset rolling mill in which said top and bottom working rolls are used as driving rolls, and axes of said top and bottom working rolls are arranged so as to be offset to a rolled material outlet side opposite to a side of larger tension action on the rolled material with respect to axes of said top and said bottom supporting rolls, and wherein means for preventing axial end portions of said top and bottom working rolls from being moved in the rolling direction are provided.

11. A tandem rolling mill facility according to claim 10, wherein said means include push bearing boxes mounted on the axial end portions of said top and bottom working rolls to support the working rolls with respect to fixed portions of said rolling mill.

12. A tandem rolling mill facility according to claim 10, wherein other of the rolling mills are rolling mills in which said top and bottom working rolls are used as driving rolls with respective axes of said top and bottom working rolls arranged so as to be offset to an inlet side of the rolled material with respect to respective axes of said top and bottom supporting rolls for the respective rolling mills.

13. A rolling method using a tandem rolling mill facility which comprises a plurality of rolling mill stands which each have a pair of top and bottom working rolls and a pair of supporting rolls for the working rolls, comprising driving said working rolls at a final one of said rolling mill stands and also offsetting the working rolls so that the axes of said top and bottom working rolls at said final stand are arranged so as to be offset to a rolled material outlet side opposite to a side of larger tension acting on the rolled material with respect to axes of the respective top and bottom supporting rolls at said final rolling mill stand.

14. A method according to claim 13, wherein said final rolling mill stand comprises an actuator for pushing bearing boxes of said top and said bottom working rolls against fixed portions.

15. A method according to claim 14, wherein said actuator is arranged so as to push the bearing boxes of said top and said bottom working rolls to the same side as the offset direction of said top and said bottom.

16. A method according to claim 14, wherein all of the rolling mill stands other than the final stage rolling mill stand include driven working rolls and comprising offsetting the working rolls of all of the other rolling mill stands such that the axes of the respective top and bottom working rolls are arranged offset to an inlet side of the rolled material with respect to axes of the top and bottom supporting rolls of the respective other rolling mill stands.

* * * * *